US010046379B1

(12) United States Patent
Greenwood

(10) Patent No.: US 10,046,379 B1
(45) Date of Patent: Aug. 14, 2018

(54) HEAT EXCHANGER FIN FORMING MACHINE

(76) Inventor: Robert Greenwood, San Juan Capistrano, CA (US)

( * ) Notice: Subject to any disclaimer, the term of this patent is extended or adjusted under 35 U.S.C. 154(b) by 49 days.

(21) Appl. No.: 12/976,941

(22) Filed: Dec. 22, 2010

Related U.S. Application Data

(60) Provisional application No. 61/298,198, filed on Jan. 25, 2010.

(51) Int. Cl.

| | |
|---|---|
| ***B21D 13/02*** | (2006.01) |
| ***B21D 53/02*** | (2006.01) |
| ***B21D 51/16*** | (2006.01) |
| ***B21D 53/04*** | (2006.01) |

(52) U.S. Cl.
CPC ..... *B21D 53/022* (2013.01); *B21D 51/16* (2013.01); *B21D 53/04* (2013.01); *B21D 13/02* (2013.01)

(58) Field of Classification Search
CPC ..... B21D 53/022; B21D 13/02; B21D 53/04; B21D 23/00; B21D 38/00; B21D 51/16
USPC ..... 29/890
See application file for complete search history.

(56) References Cited

U.S. PATENT DOCUMENTS 3,828,705 A * 8/1974 Morrison ..... B21D 13/02 72/332
4,434,637 A * 3/1984 Bailey ..... B21D 13/02 226/45
4,450,706 A * 5/1984 Engelmohr ..... B21D 13/02 378/149
5,937,519 A * 8/1999 Strand ..... B21D 13/00 29/890.03
6,591,647 B2 * 7/2003 Gerard ..... B21D 13/02 72/17.3
7,637,011 B2 * 12/2009 Bruck ..... B01J 35/04 29/430
8,402,805 B2 * 3/2013 Leon ..... B64C 3/26 72/226
2011/0229689 A1 * 9/2011 Giang ..... B01J 19/32 428/141

* cited by examiner

*Primary Examiner* — David B Jones
(74) *Attorney, Agent, or Firm* — Robert E. Lyon

(57) ABSTRACT

What is disclosed is a fin forming machine for making fins for heat exchanger cores, or the like, in which the fin forming machine has three major drives and separate controls; the top and bottom drives control the vertical opening and closing of fin forming dies under programmable control in accordance with CNC technology; and a center drive under the control of a separate programmable system which controls horizontal movement of the feedstock into intersection with the top and bottom forming dies to incrementally halt the movement of the feedstock as it intersects with the forming dies upon convergence during fin formation and then advances it a controllable distance for the next fin forming action. These three drive systems being seamlessly variable and controllable during operation, maintain a high degree of calibration of the formation of each fin to maintain fin height and spacing within very close tolerances, which calibrations are achieved without shutting down machine operation. Positive control of all drive systems minimizes overtravel of the forming dies.

8 Claims, 3 Drawing Sheets

HEAT EXCHANGER FIN FORMING MACHINE

CROSS-REFERENCE TO PROVISIONAL PATENT APPLICATION

Domestic priority is hereby claimed, pursuant to 35 U.S.C. 119(E), from U.S. Provisional Patent Application Ser. No. 61/298,198, filed Jan. 25, 2010, the entire disclosure of which shall be deemed to be incorporated by reference herein.

BACKGROUND OF THE INVENTION

Technical Field of the Invention

The present invention relates, generally, to an integration of hardware and controlling software to provide a machine for the formation of the fins employed in the core of "plate and frame" heat exchangers.

Description of the Field and of the Prior Art

A plate-frame-fin heat exchanger consists essentially of pairs of flat plates which define the horizontal peripheral dimensions of the exchanger unit and a plurality of spacer bars at the ends of the fin-stacks to be sandwiched between the flat plates to define the vertical dimensions of the fin-stack, the combination sandwich thus defining the exterior boundaries of the heat exchanger. The spacer bars provide not only the physical dimensions but the structural integrity of the device. Extended surface, or heat exchange fins became the method of choice for producing the desired performance. Any metal that can be produced as a thin sheet and subsequently formed can be used to fabricate such a heat exchanger, but aluminum is the most common because of its good thermal properties and light weight. The fin portion of the heat exchanger consists of a large number of fins which have their vertical axes normal to the surface of the flat plates and define a labyrinth of passageways. In assembly, the passageways of a first sandwich are oriented 90 degrees of the next sandwich and so on. The layers that are oriented one way are ultimately to be connected to a manifold and to an inlet port, and the layers oriented 90 degrees from the other layers are connected to another manifold and provide the outlet port. The basic concept in high efficiency heat exchangers is to provide as much surface area contact in the inlet and outlet passageways so as to affect heat transfer from the hot gas or fluid to the low temperature gas or fluid in as efficient a manner as possible. Depending upon the medium employed (gas/fluid or gas/gas or fluid/fluid) a multitude of different fin dimensions and spacings are employed, and the lateral surfaces of the fins are often varied in some instances to reduce laminar flow surface effect for higher efficiency heat exchange.

As mentioned above, the physical dimensions of a given heat exchanger device are basically governed by the size of the top and bottom plates and by the dimensions of the spacer bars. Brazing has become the commonly accepted method of assembly as the most cost effective. Once the fins are placed between the plates and edged by the spacer bars, the assembly is placed in a press in a high temperature brazing oven to fabricate an integral heat exchanger, bonding the edges of the fins evenly and uniformly to the top and bottom plates, that is, to the inner surfaces of the top and bottom plates. Here there is a critical relationship between the height of the formed fins and height of the rigid spacer bars. The generally accepted criteria for most exchangers of moderate size is to form a fin height 0.001" greater than the height of the spacer bar. Any greater fin height could result in buckling of some fins during the compression phase in the press; while any less height could result in a failure to make adequate contact during the brazing process. Either defect could result in an inadequate bond. It should be readily apparent that precision control of the fin height throughout the forming process is essential, as irregularities that go unnoticed will result in occasional "holidays" along the fin-plate interface which will produce an inferior product, causing rejection of the entire finished work.

The basic shape and dimension of a selected fin design is in the first instance determined by forming dies which consist of male and female die structures. A thin sheet is fed from a roll of material and the sheet is advanced to the open forming dies where the advancement is temporarily halted and the dies are actuated to close the male die into the female die forming a fin the width of the sheet. Drive motors actuate the upper and lower slides which move the male and female dies vertically into and out of engagement. A third drive motor is responsible for the longitudinal advance of the sheet material into the fin forming device. The basic essentials of the prior art fin forming machines are thus understood, and largely remain unchanged, however prior art fin forming machines lacked sufficient precision of control of the motions of the three drive motors, and were severely lacking in means for both obtaining and maintaining precise adjustments. This requires a more detailed explanation of the prior art devices.

Predecessor fin-forming machines are manufactured by Robinson Fin Machine, Inc., a company currently located in Kenton, Ohio. Their "Twin Fold" machine is believed to have been available since the mid-1960's employing a twin cam operation. In the Robinson machines a thin sheet is fed from a roll to a station where a lubricant coats both sides of the sheet. The sheet is advanced to the open forming dies, where it is halted and the dies actuated by one or more cams, forming a fin along the width of the sheet. The entire manufacturing operation is powered by a rotating shaft, with the sequencing steps controlled by a group of cams, gears, and levers which are linked to the primary power drive shaft. Hydraulic and/or pneumatic actuators are employed for these tasks under the control of the drive mechanism. The die set is opened by the cams, and the sheet is advanced the proper distance to repeat the cycle, delivering the desired fin height and number of fins per unit length. The advance is calibrated in a manual setup procedure when dies are selected to produce a desired fin configuration. The die sets are affixed to operating arms possessing considerable mass, so as to assure complete closure of the dies to form a completed fin, and the primary rotating cam set generally has a large moment of inertia, to reduce the power rating of the drive motor required for the stepwise sequence. Other variations of the two axis machine exist, one with a single cam located below the work table, which is claimed to reduce setup time when changing fin forming dies.

Experience with the Robinson family of machines proved the following operational disadvantages. When setting up a particular die set, to make a specific size and shape of fins, set-up time to adjust the rather crude adjustment controls often took 3 to 4 hours, with the adjustments, measurements and calibrations needed. Upon actual use, it was necessary to constantly manually monitor fin height at the output side, because, as mentioned earlier, uniformity of height is absolutely essential. It was found that this calibration could only be maintained for about 3 to 4 hours of run time. It is believed that the high inertia movements of the massive parts of this machine contribute to the instability of the mechanism's calibration. Understanding that fin height must be maintained within +/−0.001", it is not difficult to comprehend that these massive structures could not long maintain such dose tolerance adjustments, given the mass and inertia of their operating parts banging together repetitively. Hence, it was the experience that the machines would need to be shut down at least once or twice on a daily basis, reset and recalibrated. This normally would involve a downtime for reset and recalibration anywhere between 20 to 30 minutes each event. The labor-time contribution of these requirements (on-situ monitoring and recalibration) added unnecessary overhead costs to the fin manufacturing operation. Typically, during an eight hour working shift, it could be a "good day" if one accomplished 6 hours of production; and if fin-height monitoring showed unacceptable variations, there would be loss of material as well. In addition these Robinson machines lacked some needed controls and being massive, heavy structures operated with considerable bulk and concomitant noise and vibration, awarding the workplace with an unpleasant work environment.

SUMMARY OF THE INVENTION

It is a general object of the present invention to provide an improved fin folding machine which overcomes the defects and disadvantages of the prior art by providing a machine that maintains continuous and variable control over all movements and settings of the machine.

It is a more specific object of the present invention to provide an improved fin folding machine which by utilizing programmable control can achieve precise calibrations of the machine movements within desired tolerances.

It is a further object of the present invention to provide a fin folding machine in which close tolerances can be maintained throughout machine run time by providing positive and continuous control over all drivers.

It is another object of the present invention to provide a fin folding machine in which the height of each folded thin can be precisely maintained throughout runtime.

It is a more specific object of the present invention to provide in a fin folding machine the ability to continuously calibrate fin height during runtime.

It is another specific object of the present invention to provide a fin folding machine having the ability to continuously adjust for proper fin height and spacing during runtime.

It is a further object of the present invention to provide a fin folding machine which through the maintenance of positive controls eliminates or reduces downtime.

It is a more specific object of the present invention to provide a fin folding machine which maintains positive control of fin height through seamlessly variable adjustments of the drive motors.

It is a another specific object of the present invention to provide a fin folding machine which maintains positive control of fin spacing through seamlessly variable adjustments of the drive motors.

It is a another specific object of the present invention to provide a fin folding machine which maintains positive control of fin height and spacing through seamlessly variable adjustments of the drive motors, and which further provides tracking of the number of fins formed to achieve a specific-sized length of fins.

It is a general object of the present invention to provide improved control of the drive motors in a fin folding machine to reduce or eliminate unnecessary machine movements.

It is a specific object of the present invention to provide through improved control of the drive motors, increased speed of throughput, and decreased power consumption.

It is a specific object of the present invention to provide an operator input interface control by which the machine can be continuously monitored and the calibrated settings controlled while the machine is in operation.

It is one of the advantages of the present invention that control means is provided to count the number of fins made for meeting preset cutoff criteria.

In summary, the foregoing objects and advantages are accomplished in the present invention by providing computer control over the device drivers that control the top, middle and bottom slide assemblies. The top and bottom slide assemblies are the portions of the device which bring the die pieces together to fold the sheet material. Precise vertical movements of the top and bottom drive assemblies ultimately control the depth to which the mail die inserts into the female die, thereby controlling fin height. The middle slide assembly controls the horizontal movement of the sheet material into the forming dies and incrementally starts and stops its movement so as to control spacing between successive fins; and pausing the movement while the dies are brought together. The operator input control to the software system allows the operator to monitor both vertical and horizontal movement of the drive motors to maintain desired fin height within desired tolerances, and by providing control over the horizontal drive motor maintains desired spacing between successive fins; and to otherwise provide control instructions to all drive motors to continuously maintain calibration of all parameters. The control system further provides the ability to "count" the number of successive fins formed so as to provide a "marker" signifying the achievement of a desired length of formed fins. A further improvement provided by the present invention over the prior art is that positive control is maintained over the top and bottom drive motors to precisely control the distance of travel of the top and bottom tool slides. Unlike the prior art devices which had no control over the distance of travel of the top and bottom dies, the present invention allows the top and bottom drive motors to be controlled so that they only move apart a distance sufficient to allow clearance of the folded fins to pass there-through. This control over the range of travel of the top and bottom dies increases rate of production and also reduces power consumption. The elimination of wasted vertical motion allows the present device to move more smoothly with less shock, vibration and noise. Less energy is consumed by this improved device as compared to prior art devices because the forces are applied only when required and only in the direction and degree needed to form each fin, and in the overall reduction of the number of defective fins formed. The latter is accomplished in the present invention by reducing the number of defects in fin height. In Post-production of a heat exchanger following the brazing operation, the finished product is subjected to pressure tests up to 500 psi. Failure of this test is usually the result of at least one portion of one fin not adequately bonding to an upper or lower plate. A substantial reduction in the number of heat exchanger cores that fail pressure testing obviously reduces the consumption of power needed to manufacture additional fins to meet production goals. The positive and continuous control of the drive motors through the computer instructions from the operator input interface control reduces manual input, particularly the initial setup input; and significantly eliminates or at least substantially reduces downtime of the overall machine. Moreover, there are a finite number of sets of forming dies and as each set of forming dies is placed in the machine for a manufacturing run, the setup instructions for each set of dies is retained in memory, thereby further reducing setup time when switching from one set of dies to another.

While a number of objects, features and advantages of the present invention have been described and summarized, these and others will become apparent when considered in combination with the accompanying drawings which illustrate preferred embodiments of the present invention. It should, however, be noted that the accompanying drawing figures are intended to illustrate only certain embodiments of the claimed invention and are not intended to define the limits and scope of the invention as a whole.

BRIEF DESCRIPTION OF THE DRAWING FIGURES

In the drawings, similar reference numerals and symbols denote similar features or elements throughout the several views.

DETAILED DESCRIPTION OF THE DRAWING FIGURES AND PREFERRED EMBODIMENTS

Figure 3:
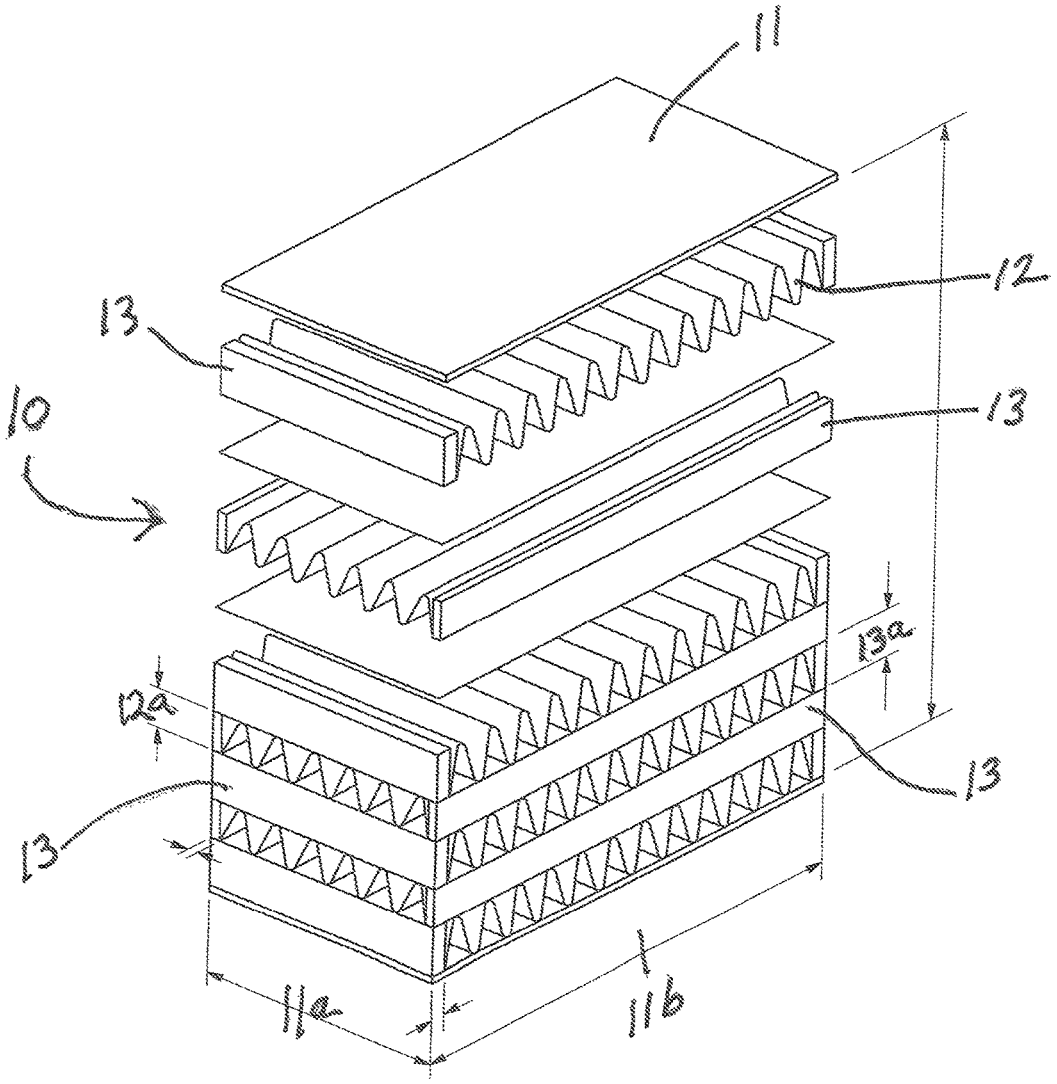
FIG. 3 is a graphical representation of a typical heat exchanger core, partially exploded, to illustrate the basic elements of a plate-frame heat exchanger.

Turning first to FIG. 3 of the drawings, this figure represents the basic pieces or elements of a typical "plate and frame" heat exchanger 10. The plate and frame heat exchanger consists primarily of three essential elements, flat plates 11, folded fins 12 and end or spacer bars 13. The bars 13 are situated at the extreme ends of each of the runs of formed fins 12. As will be seen in FIG. 3, the runs of fins 12 are alternately set transversely and longitudinally within the structure. The end bars 13 of a transversely oriented set of fins join with the end bars of the longitudinally oriented fins to form the aforementioned spacer bars. The vertical die dimension 13*a* of an end bars 13 provides the structural limitation of size on each run of formed fins when a run of fins is sandwiched between a first flat plate and the next adjacent flat plate and when these parts are brazed together into an integral unit, a fin-defined set of passageways is provided. The heat exchanger unit or core shown in FIG. 3 has four transverse fin passage elements in three longitudinally oriented fin passageways. The peripheral dimensions of the flat plates are defined by dimensions 11*a*-11*b*. As mentioned heretofore, prior to the compression and brazing steps of core construction, the vertical dimension 12*a* of fins 12 shall be greater than the vertical dimension 13*a* of end bars 13, as it is the function of the end bars 13 to provide the spacing between the run of fins and provide the outermost dimension of each fin stack. By providing the vertical dimension 12*a* of fins 12 one thousandths of an inch greater than the vertical dimension 13*a* of the spacer bars, proper contact of the entire edge of every fin with the adjacent plate, on the top and bottom of a set of fins is assured so that during the brazing process a proper bond is obtained along the entire length of every fin.

Figure 1:
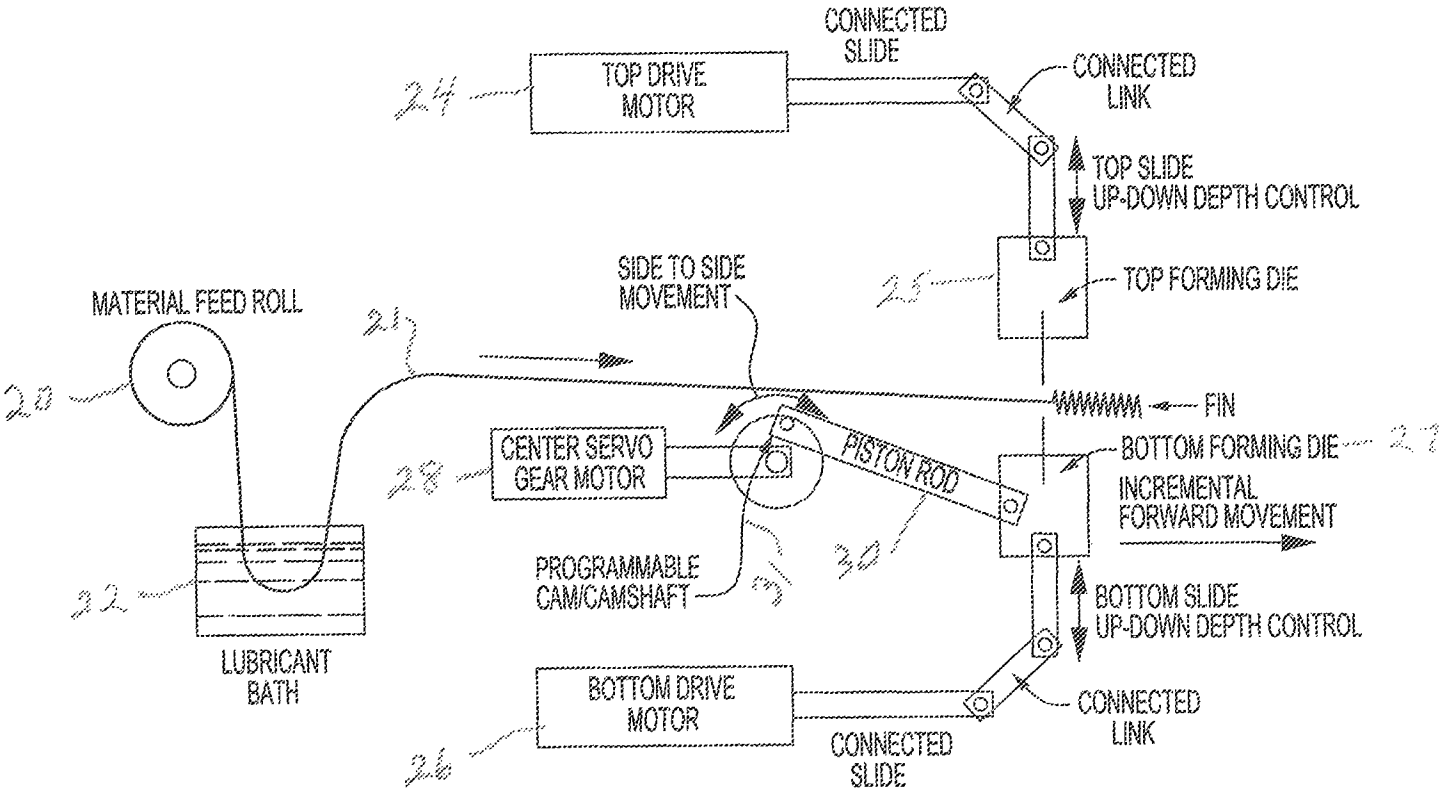
FIG. 1 is a diagrammatic representation illustrative of the basic elements and functions of the various parts of the fin forming machine.

Turning now to FIG. 1, the operation of the fin forming machine is described. The fin material is usually formed of aluminum having a thickness on the order of 0.060" to 0.080" and is normally provided in coils or rolls 20. The fin material feeds off of the roll 20 and passes through a lubricant bath 22 to facilitate the passage of the feedstock through the fin forming machine. Other forms of lubrication are contemplated such as lubricant misting, which may not be as environmentally acceptable. It will be seen that there are basically three drive motors which operate the machine; the top and bottom drive motors 24 and 26 control the vertical movement of the top and bottom dies 25 and 27. The center servo motor 28 controls the advance of the feed material 21 into the forming dies. Upon instructions entered by the operator which inputs information from a control panel which may be a touch screen, digital signals containing information on dimensional movements and timing are relayed to the three servomotors 24, 26 and 28 where these digital signals are converted into linear motion. This manner of conversion and the control by servomotors is typical of that employed in other CNC machine control mechanisms employing techniques well known in the art. The vertical motion of the top forming die 25 and bottom forming die 27 may each be incrementally and seamlessly adjusted to obtain the desired depth of convergence of the dies 25 and 27 so as to accomplish a desired fin height. Similarly, instructions to the center servo motor 28 provide information to an internally contained programmable cam assembly 31 located in the center servo motor mechanism which controls a piston rod 30 to provide side to side movement or incremental forward movement of the sheet material as it is projected between the top and bottom forming dies. The center servo motor advances the sheet of material to a position between the forming dies where it momentarily halts the movement while the top and bottom dies are converged to fold a fin and then removed, whereupon central server motor advances the sheet material incrementally forward again. The distance the sheet material 21 is advanced between top and bottom forming dies is controlled by the central servo motor programmable cam which can be variably adjusted according to the digital signals sent to it through the computer program under the control of the operator input. This controls the spacing between successive fins, and likewise controls the rate of advance of the material through the fin forming machine. Positive control exercised over the top and bottom servomotors provides precise control over fin height. The control of the top and bottom drive motors 24 and 26 also determines the amount by which the top die 25 and bottom die 27 diverge to clear a previously formed fin. In the preferred embodiment of the invention the control of the top and bottom drive motors discretely controls the amount of divergence of the top and bottom forming dies so that no more motion is required to clear a formed fin than is necessary. In this way the present invention differs from the prior art in that the prior art devices are not known to have any limitation on the movement of the top and bottom forming dies but rather merely move as far apart as mechanically possible. That resulted in a great deal of lost motion and an unnecessary consumption of power and therefore energy.

As heretofore explained, by providing precise, variable control of the device drivers for the top, bottom and center drive motor, the precise height and spacing of folded fins can be maintained within 0.001" inch of the desired fin height.

Moreover, through the operator input control interface, fin height that is continuously monitored may be adjusted during operation so that the desired tolerances are always maintained without any down-time for recalibration. The reduction in the divergence distance between the top and bottom forming dies after fin formation achieves a smoothness of operation as well as an economy of motion wherein the top and bottom dies separate from one another only so much as is necessary to allow the formed fins to pass between them. This mechanism allows the aluminum sheet to move more uniformly and quickly through the dies with the least amount of wasted motion with a substantial reduction in energy consumption in that force is applied only when required and only in the direction needed to form a fin. A secondary benefit of positive control over the drive motors is that the smooth operation yields a substantial reduction in noise and vibration compared to other prior art devices, thus increasing the environmental quality of the workplace. By providing positive control of movement and therefore of the tolerances required for proper fin formation, the present device eliminates the downtime prior art devices previously required to allow for readjustment and recalibration of the mechanical systems. Equally important, positive control over fin height is achieved to a much greater degree such that the number of heat exchanger cores failing the post-fabrication pressure tests is substantially reduced, resulting in an economy of wasted material and increasing the overall economy of production. In addition, the control mechanism of the horizontal drive motor also may measure the number of fins formed so as to provides a marker to signify the achievement of a desired length of fins so that manual measurement is not necessary to determine where to cut the formed fins into a desired length.

Figure 2:
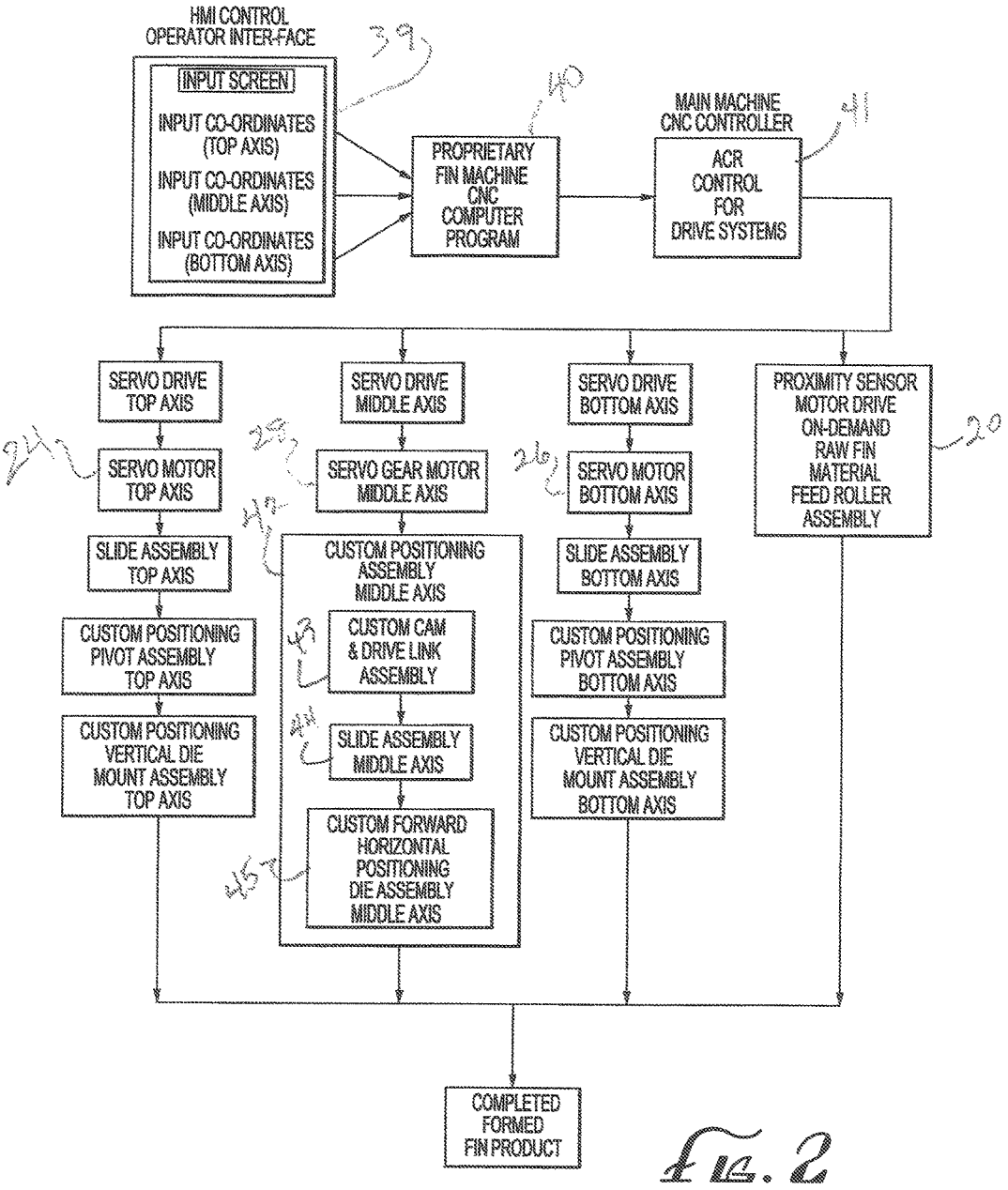
FIG. 2 is a flowchart of the controls of the overall machine from the operator input device to the endpoint where a completed, formed fin is produced.

Turning now to FIG. 3 of the drawings, a flowchart of the basic features of the control system is set forth. The features of the computer control system and the logic steps performed should be self-explanatory from FIG. 3. The basic operation is as follows: the operator inputs coordinate figures into the operator control interface panel 39, which then passes the information through the proprietary computer program 40 which directs the individual coordinate information through the ACR control 41 which directs the information in digital format to the top, middle and bottom servo (drive) motors 24, 28 and 26 respectively. Information delivered to the servo drives on the three servomotors 24, 28 and 26 converts each digital signal into linear motion which controls the top, middle and bottom positioning devices to control their horizontal and vertical positioning in accordance with conventional CNC control technology. While control of the top and bottom slide assembly and control motors follows fairly conventional CNC technology and techniques, with respect to the middle drive, there are additional control features. The center servo motor 28 includes a programmable cam/camshaft 31, and this is exemplified in FIG. 2 by the custom positioning assembly controls 42 which include a custom cam and the drive link assembly control 43 which controls the action of the slide assembly along the middle or horizontal axis which gives directions to the custom forward horizontal positioning die assembly 45. This control drive and its program provides directions to the horizontal drive assembly to provide incremental forward movement and can be adjusted through the programming means so that the servo motor 28 incrementally advances the fin material through the tooling dies. The variable adjustment of the camshaft 31 in the center control drive may be fully programmed so as to determine the distance between the tooling teeth, which provides that the desired spacing between the fins. In other words, the programmable camshaft provides information which adjusts the center drive motor, in effect by varying the effective length of the camshaft 31, to advance the sheet material the desired distance, whereupon it momentarily halts for the convergence of the top and bottom dies to form a fin and then determines the amount by which the feed material will be advanced until it stops again for the next fin formation, thereby establishing the desired spacing between each fin.

While discrete embodiments of the present invention have been shown and described it will be apparent to those skilled in the art that there a number of ways that the objectives and improvements described for the present invention can be accomplished; and it is therefore contemplated that the invention is not limited to the preferred embodiments shown and described herein, but that the invention be defined by the accompanying claims.

What is claimed is:

1. Apparatus for forming a continuous sheet of material into a horizontal series of uniformly-sized folded fins, comprising:

a set of forming dies positioned for moving along a vertical axis of said apparatus, said set of forming dies including an upper die and a lower die and being mounted upon an upper slide assembly and a lower slide assembly;

means for moving a sheet of material along a horizontal axis of said apparatus to a location wherein the horizontal axis and the vertical axis intersect, said means for moving a sheet of material being programmably operative for halting horizontal movement of the sheet of material; and, means for moving said set of forming dies together for converging upon the sheet of material at an intersection of said horizontal axis and said vertical axis when the horizontal movement is halted, thereby forming said series of uniformly-sized folded fins;

and further including programmable means for independently controlling said top drive motor and said bottom drive motor for moving said top and said bottom dies a distance sufficient for achieving, upon convergence, uniformly-sized folded fins.

2. The apparatus for forming a continuous sheet of material into a series of uniformly-sized folded fins according to claim 1 wherein said means for moving a sheet of material along a horizontal axis comprises:

program means for controlling horizontal displacement of the sheet of material in increments;

said program means including means for halting the horizontal displacement of the sheet of material upon each incremental movement, thereby providing a series of vertical fins of a chosen size within said series of fins.

3. The apparatus for forming a continuous sheet of material into a series of uniformly-sized folded fins according to claim 2 wherein;

said means for vertically moving said set of forming dies together for converging upon the sheet of material at an intersection of said horizontal axis and said vertical axis includes means for controlling vertical travel of said upper slide assembly and said lower slide assembly toward convergence so that depth of engagement of said upper die and said lower die upon convergence is controllable for precisely setting the height to which each said uniformly-sized fin, within a series of fins, is formed.

4. The apparatus for forming a continuous sheet of material into a series of uniformly-sized folded fins according to claim 3, further comprising;

means for vertically controlling said upper slide assembly and said lower slide assembly following convergence upon the sheet of material at an intersection of said horizontal axis and said vertical axis, so that said upper die and said lower die diverge only a distance marginally greater than the height of a last formed fin.

5. The apparatus for forming a continuous sheet of material into a series of uniformly-sized folded fins according to claim 3, wherein;

said means for moving said set of forming dies along a vertical axis of said apparatus includes programmable controls for said top and bottom drives, wherein said moving means for said top and said bottom dies includes control means for moving said dies distances adequate to achieve selectable variable sizes of folded fins.

6. The apparatus for forming a continuous sheet of material into a series of uniformly-sized folded fins according to claim 3, wherein said means for moving a sheet of material along a horizontal axis comprises:

programmable means for controlling horizontal displacement of the sheet of material, and programmable controls for setting said incremental displacement, means for temporally halting the horizontal displacement of the sheet of material upon each incremental movement; and, wherein said programmable controls for setting incremental horizontal displacement are continuously operative to achieve uniform horizontal displacement between successively folded fins in a series of fins.

7. The apparatus for forming a continuous sheet of material into a series of uniformly-sized folded fins according to claim 3, wherein said means for moving a sheet of material along a horizontal axis comprises:

programmable means for determining the number of successively formed fins which have been formed; and further comprises programmable means for signaling a point along the horizontal axis for cutting the sheet of material following the formation of a series of formed fins.

8. The apparatus for forming a continuous sheet of material into a series of uniformly-sized folded fins according to claim 1 or 3 or 5, wherein said means for moving said set of forming dies along a vertical axis of said apparatus includes programmable controls for said top and bottom drives, and wherein;

said moving means for said top and said bottom dies includes programmable controls for moving said dies distances adequate to achieve close tolerances of fin height of each fin within a series of formed fins.

* * * * *